US009961466B2

(12) United States Patent
Oh et al.

(10) Patent No.: US 9,961,466 B2
(45) Date of Patent: May 1, 2018

(54) AUDIO SIGNAL PROCESSING APPARATUS AND METHOD FOR BINAURAL RENDERING

(71) Applicant: GAUDI AUDIO LAB, INC., Seoul (KR)

(72) Inventors: Hyunoh Oh, Seongnam-si (KR); Taegyu Lee, Seoul (KR); Yonghyun Baek, Seoul (KR)

(73) Assignee: GAUDI AUDIO LAB, INC., Seoul (KR)

( * ) Notice: Subject to any disclaimer, the term of this patent is extended or adjusted under 35 U.S.C. 154(b) by 0 days. days.

(21) Appl. No.: 15/611,783

(22) Filed: Jun. 1, 2017

(65) Prior Publication Data

US 2017/0272882 A1 Sep. 21, 2017

Related U.S. Application Data

(63) Continuation of application No. PCT/KR2015/013277, filed on Dec. 4, 2015.

(30) Foreign Application Priority Data

Dec. 4, 2014 (KR) ..... 10-2014-0173420
Jan. 30, 2015 (KR) ..... 10-2015-0015566
Aug. 18, 2015 (KR) ..... 10-2015-0116374

(51) Int. Cl.
*H04R 5/00* (2006.01)
*H04S 3/00* (2006.01)
*H04S 7/00* (2006.01)

(52) U.S. Cl.
CPC ..... *H04S 3/008* (2013.01); *H04S 7/303* (2013.01); *H04S 2400/11* (2013.01); *H04S 2420/01* (2013.01)

(58) Field of Classification Search
USPC ..... 381/17, 18, 23.1, 71.14, 71.11, 60, 94.3, 381/98, 164, 316, 402
See application file for complete search history.

(56) References Cited

U.S. PATENT DOCUMENTS

2010/0002886 A1* 1/2010 Doclo ..... H04R 25/552 381/23.1

FOREIGN PATENT DOCUMENTS

EP 1 014 756 * 12/1999 ..... H04S 3/02
EP 1014756 A2 6/2000
(Continued)

OTHER PUBLICATIONS

International Search Report and Written Opinion of the International Searching Authority dated Apr. 12, 2016 for Application No. PCT/KR2015/013277.

*Primary Examiner* — Yosef K Laekemariam
(74) *Attorney, Agent, or Firm* — Park, Kim & Suh, LLC

(57) ABSTRACT

The present invention relates to an audio signal processing apparatus and an audio signal processing method to perform binaural rendering. To this end, provided are an audio signal processing apparatus to perform binaural filtering an input audio signal, including: a first filtering unit configured to filter the input audio signal by a first lateral transfer function to generate a first lateral output signal; and a second filtering unit configured to filter the input audio signal by a second lateral transfer function to generate a second lateral output signal, wherein the first lateral transfer function and the second lateral transfer function are generated by modifying an interaural transfer function (ITF) with respect to the input audio signal and an audio signal processing method using the same.

16 Claims, 5 Drawing Sheets

(56) References Cited

FOREIGN PATENT DOCUMENTS

| | | | |
|---|---|---|---|
| WO | 2002/003749 | A2 | 1/2002 |
| WO | 2007/028250 | A2 | 3/2007 |
| WO | 2014/178479 | A1 | 11/2014 |

* cited by examiner

AUDIO SIGNAL PROCESSING APPARATUS AND METHOD FOR BINAURAL RENDERING

CROSS-REFERENCE TO RELATED APPLICATIONS

This application claims the benefit under 35 U.S.C. § 120 and § 365(c) to a prior PCT International Application No. PCT/KR2015/013277, filed on Dec. 4, 2015, which claims the benefit of Korean Patent Application No. 10-2014-0173420, filed on Dec. 4, 2014, Korean Patent Application No. 10-2015-0015566, filed on Jan. 30, 2015, and Korean Patent Application No. 10-2015-0116374 filed on Aug. 18, 2015, the entire contents of which are incorporated herein by reference.

TECHNICAL FIELD

The present invention relates to an audio signal processing apparatus and an audio signal processing method for performing binaural rendering.

BACKGROUND ART 3D audio collectively refers to a series of signal processing, transmitting, coding, and reproducing technologies which provide another axis corresponding to a height direction to a sound scene on a horizontal surface (2D) which is provided from surrounding audio of the related art to provide sound having presence in a three dimensional space. Specifically, in order to provide 3D audio, a larger number of speakers need to be used as compared than the related art or a rendering technique which forms a sound image in a virtual position where no speaker is provided even though a small number of speakers are used is required.

The 3D audio may be an audio solution corresponding to an ultra high definition TV (UHDTV) and is expected to be used in various fields and devices. There are channel based signals and object based signals as a sound source which is provided to the 3D audio. In addition, there may be a sound source in which the channel based signals and the object based signals are mixed and thus a user may have a new type of listening experience.

Meanwhile, the binaural rendering is a processing which models an input audio signal as a signal which is transferred to both ears of a human. The user could feel a 3D sound effect by listening to two channel output audio signals which are binaurally rendered through a headphone or an earphone. Therefore, when the 3D audio is modeled as an audio signal which is transferred to the ears of a human, a 3D sound effect of 3D audio may be reproduced through two channel output audio signals.

DISCLOSURE

Technical Problem

The present invention has been made in an effort to provide an audio signal processing apparatus and an audio signal processing method to perform binaural rendering.

The present invention has also been made in an effort to perform efficient binaural rendering on object signals and channel signals of 3D audio.

The present invention has also been made in an effort to implement immersive binaural rendering on audio signals of virtual reality (VR) contents.

Technical Solution

In order to obtain the above object, the present invention provides an audio signal processing method and an audio signal processing apparatus as follows.

An exemplary embodiment of the present invention provides an audio signal processing apparatus to perform binaural filtering an input audio signal, including: a first filtering unit which filters the input audio signal by a first lateral transfer function to generate a first lateral output signal; and a second filtering unit which filters the input audio signal by a second lateral transfer function to generate a second lateral output signal, in which the first lateral transfer function and the second lateral transfer function may be generated by modifying an interaural transfer function (ITF) obtained by dividing a first lateral head related transfer function (HRTF) by a second lateral HRTF with respect to the input audio signal.

The first lateral transfer function and the second lateral transfer function may be generated by modifying the ITF based on a notch component of at least one of the first lateral HRTF and the second lateral HRTF with respect to the input audio signal.

The first lateral transfer function may be generated based on the notch component extracted from the first lateral HRTF and the second lateral transfer function may be generated based on a value obtained by dividing the second lateral HRTF by an envelope component extracted from the first lateral HRTF.

The first lateral transfer function may be generated based on the notch component extracted from the first lateral HRTF and the second lateral transfer function may be generated based on a value obtained by dividing the second lateral HRTF by an envelope component extracted from a first lateral HRTF which has a different direction from the input audio signal.

The first lateral HRTF having the different direction may be a first HRTF having the same azimuth as the input audio signal and having an altitude of zero.

The first lateral transfer function may be finite impulse response (FIR) filter coefficients or infinite impulse response (IIR) filter coefficients generated using a notch component of the first lateral HRTF.

The second lateral transfer function may include an interaural parameter generated based on an envelope component of a first lateral HRTF and an envelope component of a second lateral HRTF with respect to the input audio signal and impulse response (IR) filter coefficients generated based on a notch component of the second lateral HRTF, and the first lateral transfer function may include IR filter coefficients generated based on a notch component of the first lateral HRTF.

The interaural parameter includes an interaural level difference (ILD) and an interaural time difference (ITD).

Next, another exemplary embodiment of the present invention provides an audio signal processing apparatus to perform binaural filtering an input audio signal, including an ipsilateral filtering unit which filters the input audio signal by an ipsilateral transfer function to generate an ipsilateral output signal; and a contralateral filtering unit which filters the input audio signal by a contralateral transfer function to generate a contralateral output signal, in which the ipsilateral and contralateral transfer functions are generated based on different transfer functions in a first frequency band and a second frequency band.

The ipsilateral and contralateral transfer functions of the first frequency band may be generated based on an interaural transfer function (ITF) and the ITF may be generated based on a value obtained by dividing an ipsilateral head related transfer function (HRTF) by a contralateral HRTF with respect to the input audio signal.

The ipsilateral and contralateral transfer functions of the first frequency band may be an ipsilateral HRTF and a contralateral HRTF with respect to the input audio signal.

The ipsilateral and contralateral transfer functions of the second frequency band which is different from the first frequency band may be generated based on a modified interaural transfer function (MITF), and the MITF may be generated by modifying an interaural transfer function (ITF) based on a notch component of at least one of an ipsilateral HRTF and a contralateral HRTF with respect to the input audio signal.

The ipsilateral transfer function of the second frequency band may be generated based on a notch component extracted from the ipsilateral HRTF and the contralateral transfer function of the second frequency band may be generated based on a value obtained by dividing the contralateral HRTF by an envelope component extracted from the ipsilateral HRTF.

The ipsilateral and contralateral transfer functions of the first frequency band may be generated based on information extracted from at least one of an interaural level difference (ILD), an interaural time difference (ITD), an interaural phase difference (IPD), and an interaural coherence (IC) of the ipsilateral HRTF and the contralateral HRTF with respect to the input audio signal for each frequency band.

The transfer functions of the first frequency band and the second frequency band may be generated based on information extracted from the same ipsilateral and contralateral HRTFs.

The first frequency band may be lower than the second frequency band.

The ipsilateral and contralateral transfer functions of the first frequency band may be generated based on a first transfer function, the ipsilateral and contralateral transfer functions of the second frequency band which is different from the first frequency band may be generated based on a second transfer function, and the ipsilateral and contralateral transfer functions in a third frequency band between the first frequency band and the second frequency band may be generated based on a linear combination of the first transfer function and the second transfer function.

Furthermore, an exemplary embodiment of the present invention provides an audio signal processing method to perform binaural filtering an input audio signal, including: receiving an input audio signal; filtering the input audio signal by an ipsilateral transfer function to generate an ipsilateral output signal; and filtering the input audio signal by a contralateral transfer function to generate a contralateral output signal, in which the ipsilateral and contralateral transfer functions are generated based on different transfer functions in a first frequency band and a second frequency band.

Another exemplary embodiment of the present invention provides an audio signal processing method to perform binaural filtering an input audio signal, including: receiving an input audio signal; filtering the input audio signal by a first transfer function to generate a first output signal; and filtering the input audio signal by a second lateral transfer function to generate a second output signal, in which the first lateral transfer function and the second lateral transfer function may be generated by modifying an interaural transfer function (ITF) obtained by dividing a first lateral head related transfer function (HRTF) by a second lateral HRTF with respect to the input audio signal.

Advantageous Effects

According to an exemplary embodiment of the present invention, a high quality binaural sound may be provided with low computational complexity.

According to the exemplary embodiment, deterioration of a sound image localization and degradation of a sound quality which may be caused by the binaural rendering may be prevented.

According to the exemplary embodiment of the present invention, binaural rendering process to which a motion of a user or an object is reflected is allowed through an efficient calculation.

MODE FOR INVENTION

Terminologies used in the specification are selected from general terminologies which are currently and widely used as much as possible while considering a function in the present invention, but the terminologies may vary in accordance with the intention of those skilled in the art, custom, or appearance of new technology. Further, in particular cases, the terminologies are arbitrarily selected by an applicant and in this case, the meaning thereof may be described in a corresponding section of the description of the invention. Therefore, it is noted that the terminology used in the specification is analyzed based on a substantial meaning of the terminology and the whole specification rather than a simple title of the terminology.

Figure 1:
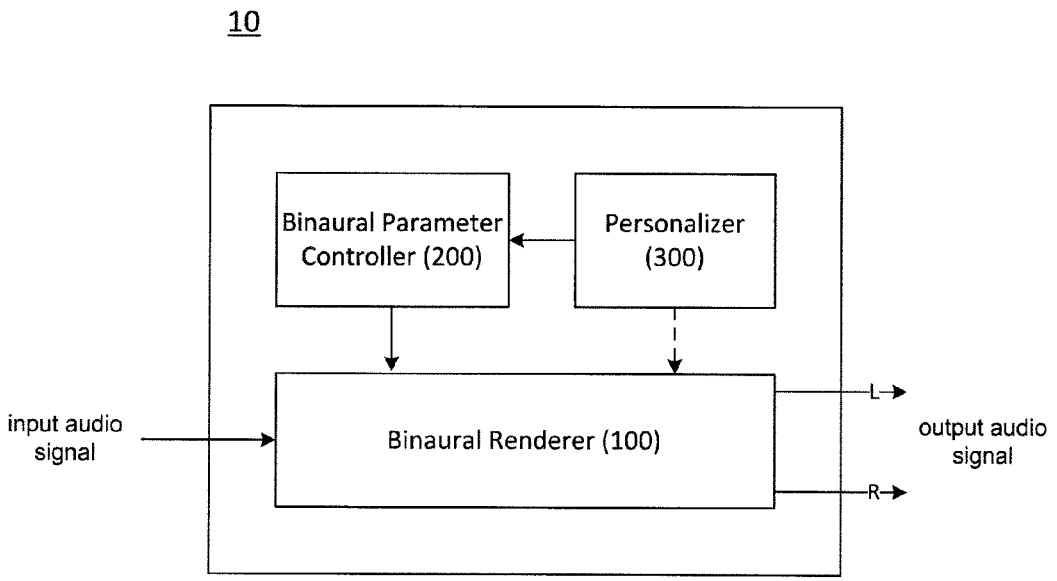
FIG. 1 is a block diagram illustrating an audio signal processing apparatus according to an exemplary embodiment of the present invention.

FIG. 1 is a block diagram illustrating an audio signal processing apparatus according to an exemplary embodiment of the present invention. Referring to FIG. 1, an audio signal processing apparatus 10 includes a binaural renderer 100, a binaural parameter controller 200, and a personalizer 300.

First, the binaural renderer 100 receives input audio and performs binaural rendering on the input audio to generate two channel output audio signals L and R. An input audio signal of the binaural renderer 100 may include at least one of an object signal and a channel signal. In this case, the input audio signal may be one object signal or one mono signal or may be multi object signals or multi channel signals. According to an exemplary embodiment, when the binaural renderer 100 includes a separate decoder, the input signal of the binaural renderer 100 may be a coded bitstream of the audio signal.

An output audio signal of the binaural renderer 100 is a binaural signal, that is, two channel audio signals in which each input object/channel signal is represented by a virtual sound source located in a 3D space. The binaural rendering is performed based on a binaural parameter provided from the binaural parameter controller 200 and performed on a time domain or a frequency domain. As described above, the binaural renderer 100 performs binaural rendering on various types of input signals to generate a 3D audio headphone signal (that is, 3D audio two channel signals).

According to an exemplary embodiment, post processing may be further performed on the output audio signal of the binaural renderer 100. The post processing includes cross-talk cancellation, dynamic range control (DRC), volume normalization, and peak limitation. The post processing may further include frequency/time domain converting on the output audio signal of the binaural renderer 100. The audio signal processing apparatus 10 may include a separate post processor which performs the post processing and according to another exemplary embodiment, the post processor may be included in the binaural renderer 100.

The binaural parameter controller 200 generates a binaural parameter for the binaural rendering and transfers the binaural parameter to the binaural renderer 100. In this case, the transferred binaural parameter includes an ipsilateral transfer function and a contralateral transfer function, as described in the following various exemplary embodiments. In this case, the transfer function may include at least one of a head related transfer function (HRTF), an interaural transfer function (ITF), a modified ITF (MITF), a binaural room transfer function (BRTF), a room impulse response (RIR), a binaural room impulse response (BRIR), a head related impulse response (HRIR), and modified/edited data thereof, but the present invention is not limited thereto.

The transfer function may be measured in an anechoic room and include information on HRTF estimated by a simulation. A simulation technique which is used to estimate the HRTF may be at least one of a spherical head model (SHM), a snowman model, a finite-difference time-domain method (FDTDM), and a boundary element method (BEM). In this case, the spherical head model indicates a simulation technique which performs simulation on the assumption that a head of a human is a sphere. Further, the snowman model indicates a simulation technique which performs simulation on the assumption that a head and a body are spheres.

The binaural parameter controller 200 obtains the transfer function from a database (not illustrated) or receives a personalized transfer function from the personarizer 300. In the present invention, it is assumed that the transfer function is obtained by performing fast Fourier transform on an impulse response (IR), but a transforming method in the present invention is not limited thereto. That is, according to the exemplary embodiment of the present invention, the transforming method includes a quadratic mirror filterbank (QMF), discrete cosine transform (DCT), discrete sine transform (DST), and wavelet.

According to the exemplary embodiment of the present invention, the binaural parameter controller 200 generates the ipsilateral transfer function and the contralateral transfer function and transfers the generated transfer functions to the binaural renderer 100. According to the exemplary embodiment, the ipsilateral transfer function and the contralateral transfer function may be generated by modifying an ipsilateral prototype transfer function and a contralateral prototype transfer function, respectively. Further, the binaural parameter may further include an interaural level difference (ILD), interaural time difference (ITD), finite impulse response (FIR) filter coefficients, and infinite impulse response filter coefficients. In the present invention, the ILD and the ITD may also be referred to as an interaural parameter.

Meanwhile, in the exemplary embodiment of the present invention, the transfer function is used as a terminology which may be replaced with the filter coefficients. Further, the prototype transfer function is used as a terminology which is replaced with a prototype filter coefficients. Therefore, the ipsilateral transfer function and the contralateral transfer function may represent the ipsilateral filter coefficients and the contralateral filter coefficients, respectively, and the ipsilateral prototype transfer function and the contralateral prototype transfer function may represent the ipsilateral prototype filter coefficients and the contralateral prototype filter coefficients, respectively.

According to an exemplary embodiment, the binaural parameter controller 200 may generate the binaural parameter based on personalized information obtained from the personalizer 300. The personalizer 300 obtains additional information for applying different binaural parameters in accordance with users and provides the binaural transfer function determined based on the obtained additional information. For example, the personalizer 300 may select a binaural transfer function (for example, a personalized HRTF) for the user from the database, based on physical attribute information of the user. In this case, the physical attribute information may include information such as a shape or size of a pinna, a shape of external auditory meatus, a size and a type of a skull, a body type, and a weight.

The personalizer 300 provides the determined binaural transfer function to the binaural renderer 100 and/or the binaural parameter controller 200. According to an exemplary embodiment, the binaural renderer 100 performs the binaural rendering on the input audio signal using the binaural transfer function provided from the personalizer 300. According to another exemplary embodiment, the binaural parameter controller 200 generates a binaural parameter using the binaural transfer function provided from the personalizer 300 and transfers the generated binaural parameter to the binaural renderer 100. The binaural renderer 100 performs binaural rendering on the input audio signal based on the binaural parameter obtained from the binaural parameter controller 200.

Meanwhile, FIG. 1 is an exemplary embodiment illustrating elements of the audio signal processing apparatus 10 of the present invention, but the present invention is not limited thereto. For example, the audio signal processing apparatus 10 of the present invention may further include an additional element other than the elements illustrated in FIG. 1. Further, some elements illustrated in FIG. 1, for example, the personalizer 300 may be omitted from the audio signal processing apparatus 10.

Figure 2:
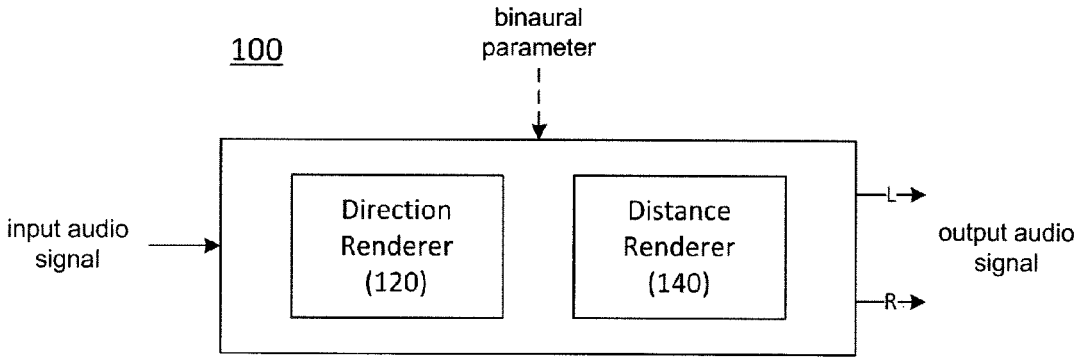
FIG. 2 is a block diagram illustrating a binaural renderer according to an exemplary embodiment of the present invention.

FIG. 2 is a block diagram illustrating a binaural renderer according to an exemplary embodiment of the present invention. Referring to FIG. 2, the binaural renderer 100 includes a direction renderer 120 and a distance renderer 140. In the exemplary embodiment of the present invention, the audio signal processing apparatus may represent the binaural renderer 100 of FIG. 2 or may indicate the direction renderer 120 or the distance renderer 140 which is a component thereof. However, in the exemplary embodiment of the present invention, an audio signal processing apparatus in a broad meaning may indicate the audio signal processing apparatus 10 of FIG. 1 which includes the binaural renderer 100.

First, the direction renderer 120 performs direction rendering to localize a direction of the sound source of the input audio signal. The sound source may represent an audio object corresponding to the object signal or a loud speaker corresponding to the channel signal. The direction renderer 120 applies a binaural cue which distinguishes a direction of a sound source with respect to a listener, that is, a direction cue to the input audio signal to perform the direction rendering. In this case, the direction cue includes a level difference of both ears, a phase difference of both ears, a spectral envelope, a spectral notch, and a peak. The direction renderer 120 performs the binaural rendering using the binaural parameter such as the ipsilateral transfer function and the contralateral transfer function.

Next, the distance renderer 140 performs distance rendering which reflects an effect in accordance with a sound source distance of the input audio signal. The distance renderer 140 applies a distance cue which distinguishes a distance of the sound source with respect to a listener to the input audio signal to perform the distance rendering. According to the exemplary embodiment of the present invention, the distance rendering may reflect a change of a sound intensity and spectral shaping in accordance with the distance change of the sound source to the input audio signal. According to the exemplary embodiment of the present invention, the distance renderer 140 performs different processings depending on whether the distance of the sound source is within a predetermined threshold value. When the distance of the sound source exceeds the predetermined threshold value, a sound intensity which is inversely proportional to the distance of the sound source with respect to the head of the listener may be applied. However, when the distance of the sound source is within the predetermined threshold value, separate distance rendering may be performed based on the distances of the sound source which are measured with respect to both ears of the listener, respectively.

According to the exemplary embodiment of the present invention, the binaural renderer 100 performs at least one of the direction rendering and the distance rendering on the input signal to generate a binaural output signal. The binaural renderer 100 may sequentially perform the direction rendering and the distance rendering on the input signal or may perform a processing in which the direction rendering and the distance rendering are combined. Hereinafter, in the exemplary embodiment of the present invention, as a concept including the direction rendering, the distance rendering, and a combination thereof, the term binaural rendering or binaural filtering may be used.

According to an exemplary embodiment, the binaural renderer 100 first performs the direction rendering on the input audio signal to obtain two channel output signals, that is, an ipsilateral output signal D^I and a contralateral output signal D^C. Next, the binaural renderer 100 performs the distance rendering on two channel output signals D^I and D^C to generate binaural output signals B^I and B^C. In this case, the input signal of the direction renderer 120 is an object signal and/or a channel signal and the input signal of the distance renderer 140 is two channel signals D^I and D^C on which the direction rendering is performed as a preprocessing step.

According to another exemplary embodiment, the binaural renderer 100 first performs the distance rendering on the input audio signal to obtain two channel output signals, that is, an ipsilateral output signal d^I and a contralateral output signal d^C. Next, the binaural renderer 100 performs the direction rendering on two channel output signals d^I and d^C to generate binaural output signals B^I and B^C. In this case, the input signal of the distance renderer 140 is an object signal and/or a channel signal and the input signal of the direction renderer 120 is two channel signals d^I and d^C on which the distance rendering is performed as a preprocessing step.

Figure 3:
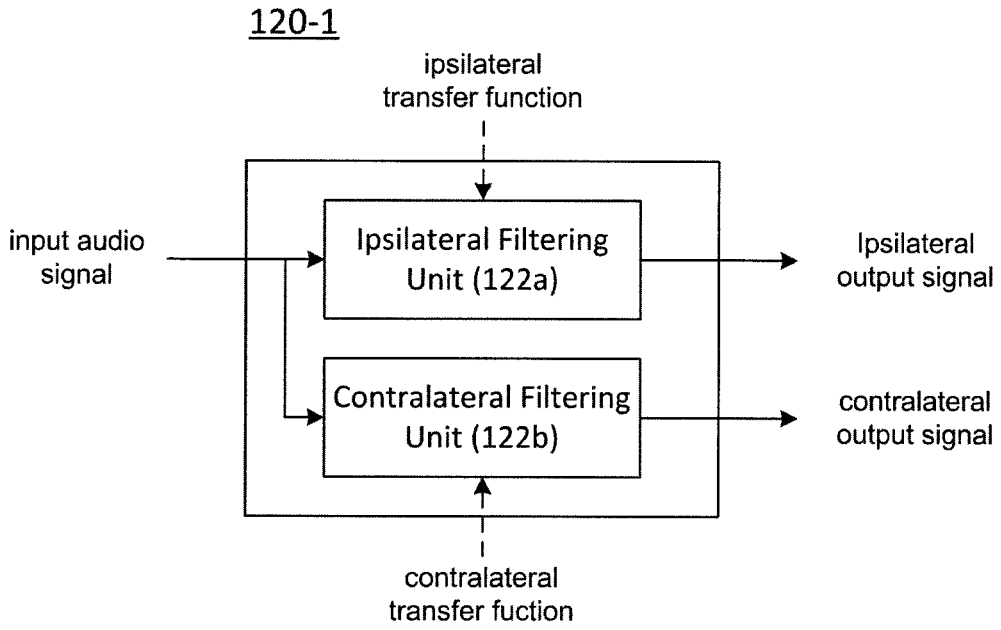
FIG. 3 is a block diagram of a direction renderer according to an exemplary embodiment of the present invention.

FIG. 3 is a block diagram of a direction renderer 120-1 according to an exemplary embodiment of the present invention. Referring to FIG. 3, the direction renderer 120-1 includes an ipsilateral filtering unit 122*a* and a contralateral filtering unit 122*b*. The direction renderer 120-1 receives a binaural parameter including an ipsilateral transfer function and a contralateral transfer function and filters the input audio signal with the received binaural parameter to generate an ipsilateral output signal and a contralateral output signal. That is, the ipsilateral filtering unit 122*a* filters the input audio signal with the ipsilateral transfer function to generate the ipsilateral output signal and the contralateral filtering unit 122*b* filters the input audio signal with the contralateral transfer function to generate the contralateral output signal. According to an exemplary embodiment of the present invention, the ipsilateral transfer function and the contralateral transfer function may be an ipsilateral HRTF and a contralateral HRTF, respectively. That is, the direction renderer 120-1 convolutes the input audio signal with the HRTFs for both ears to obtain the binaural signal of the corresponding direction.

In an exemplary embodiment of the present invention, the ipsilateral/contralateral filtering units 122*a* and 122*b* may indicate left/right channel filtering units respectively, or right/left channel filtering units respectively. When the sound source of the input audio signal is located at a left side of the listener, the ipsilateral filtering unit 122*a* generates a left channel output signal and the contralateral filtering unit 122*b* generates a right channel output signal. However, when the sound source of the input audio signal is located at a right side of the listener, the ipsilateral filtering unit 122*a* generates a right channel output signal and the contralateral filtering unit 122*b* generates a left channel output signal. As described above, the direction renderer 120-1 performs the ipsilateral/contralateral filtering to generate left/right output signals of two channels.

According to the exemplary embodiment of the present invention, the direction renderer 120-1 filters the input audio signal using an interaural transfer function (ITF), a modified ITF (MITF), or a combination thereof instead of the HRTF, in order to prevent the characteristic of an anechoic room from being reflected into the binaural signal. Hereinafter, a binaural rendering method using transfer functions according to various exemplary embodiments of the present invention will be described.

<Binaural Rendering Using ITF>

First, the direction renderer 120-1 filters the input audio signal using the ITF. The ITF may be defined as a transfer function which divides the contralateral HRTF by the ipsilateral HRTF as represented in the following Equation 1.

$$I_I(k)=1$$

$$I_C(k)=H_C(k)/H_I(k) \quad \text{[Equation 1]}$$

Herein, k is a frequency index, H_I(k) is an ipsilateral HRTF of a frequency k, H_C(k) is a contralateral HRTF of the frequency k, I_I(k) is an ipsilateral ITF of the frequency k, and I_C(k) is a contralateral ITF of the frequency k.

That is, according to the exemplary embodiment of the present invention, at each frequency k, a value of I_I(k) is defined as 1 (that is, 0 dB) and I_C(k) is defined as a value obtained by dividing H_C(k) by H_I(k) in the frequency k. The ipsilateral filtering unit 122*a* of the direction renderer 120-1 filters the input audio signal with the ipsilateral ITF to generate an ipsilateral output signal and the contralateral filtering unit 122*b* filters the input audio signal with the contralateral ITF to generate a contralateral output signal. In this case, as represented in Equation 1, when the ipsilateral ITF is 1, that is, the ipsilateral ITF is a unit delta function in the time domain or all gain values are 1 in the frequency domain, the ipsilateral filtering unit 122*a* may bypass the filtering of the input audio signal. As described above, the ipsilateral filtering is bypassed and the contralateral filtering is performed on the input audio signal with the contralateral ITF, thereby the binaural rendering using the ITF is performed. The direction renderer 120-1 omits an operation of the ipsilateral filtering unit 122*a* to obtain a gain of a computational complexity.

ITF is a function indicating a difference between the ipsilateral prototype transfer function and the contralateral prototype transfer function and the listener may recognize a sense of locality using the difference of the transfer functions as a clue. During the processing step of the ITF, room characteristics of the HRTF are cancelled and thus a phenomenon in which an awkward sound (mainly a sound in which a bass sound is missing) is generated in the rendering using the HRTF may be compensated. Meanwhile, according to another exemplary embodiment of the present invention, I_C(k) is defined as 1 and I_I(k) may be defined as a value obtained by dividing H_I(k) by H_C(k) in the frequency k. In this case, the direction renderer 120-1 bypasses the contralateral filtering and performs the ipsilateral filtering the input audio signal with the ipsilateral ITF.

<Binaural Rendering Using MITF>

When the binaural rendering is performed using ITF, the rendering is performed only on one channel between L/R pair, so that a gain in the computational complexity is large. However, when the ITF is used, the sound image localization may deteriorate due to loss of unique characteristics of the HRTF such as a spectral peak, a notch, and the like. Further, when there is a notch in the HRTF (an ipsilateral HRTF in the above exemplary embodiment) which is a denominator of the ITF, a spectral peak having a narrow bandwidth is generated in the ITF, which causes a tone noise. Therefore, according to another exemplary embodiment of the present invention, the ipsilateral transfer function and the contralateral transfer function for the binaural filtering may be generated by modifying the ITF for the input audio signal. The direction renderer 120-1 filters the input audio signal using the modified ITF (that is, MITF).

Figure 4:
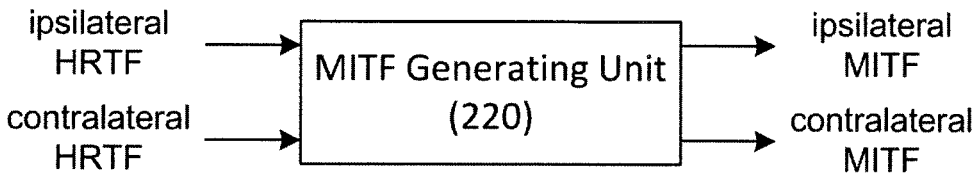
FIG. 4 is a diagram illustrating a modified ITF (MITF) generating method according to an exemplary embodiment of the present invention.

FIG. 4 is a diagram illustrating a modified ITF (MITF) generating method according to an exemplary embodiment of the present invention. An MITF generating unit 220 is a component of the binaural parameter controller 200 of FIG. 1 and receives the ipsilateral HRTF and the contralateral HRTF to generate an ipsilateral MITF and a contralateral MITF. The ipsilateral MITF and the contralateral MITF generated in the MITE generating unit 220 are transferred to the ipsilateral filtering unit 122*a* and the contralateral filtering unit 122*b* of FIG. 3 to be used for ipsilateral filtering and contralateral filtering.

Hereinafter, an MITF generating method according to various exemplary embodiments of the present invention will be described with reference to Equations. In an exemplary embodiment of the present invention, a first lateral refers to any one of ipsilateral and contralateral and a second lateral refers to the other one. For the purpose of convenience, even though the present invention is described on the assumption that the first lateral refers to the ipsilateral and the second lateral refers to the contralateral, the present invention may be implemented in the same manner when the first lateral refers to the contralateral and the second lateral refers to the ipsilateral. That is, in Equations and exemplary embodiments of the present invention, ipsilateral and contralateral may be exchanged with each other to be used. For example, an operation which divides the ipsilateral HRTF by the contralateral HRTF to obtain the ipsilateral MITE may be replaced with an operation which divides the contralateral HRTF by the ipsilateral HRTF to obtain the contralateral MITF In the following exemplary embodiments, the MITF is generated using a prototype transfer function HRTF. However, according to an exemplary embodiment of the present invention, a prototype transfer function other than the HRTF, that is, another binaural parameter may be used to generate the MITF.

(First Method of MITE—Conditional Ipsilateral Filtering)

According to a first exemplary embodiment of the present invention, when a value of the contralateral HRTF is larger than the ipsilateral HRTF at a specific frequency index k, the MITF may be generated based on a value obtained by dividing the ipsilateral HRTF by the contralateral HRTF. That is, when a magnitude of the ipsilateral HRTF and a magnitude of the contralateral HRTF are reversed due to a notch component of the ipsilateral HRTF, on the contrary to the operation of the ITF, the ipsilateral HRTF is divided by the contralateral HRTF to prevent the spectral peak from being generated. More specifically, when the ipsilateral HRTF is H_I(k), the contralateral HRTF is H_C(k), the ipsilateral MITF is M_I(k), and the contralateral MITF is M_C(k) with respect to the frequency index k, the ipsilateral MITF and the contralateral MITF may be generated as represented in the following Equation 2.

$$\begin{aligned}
&\text{if } (H_I(k)<H_C(k)) \\
&M_I(k)=H_I(k)/H_C(k) \\
&M_C(k)=1 \\
&\text{else} \\
&M_I(k)=1 \\
&M_C(k)=H_C(k)/H_I(k)
\end{aligned} \qquad \text{[Equation 2]}$$

That is, according to the first exemplary embodiment, when the value of H_I(k) is smaller than the value of H_C(k) at a specific frequency index k (that is, in a notch region), M_I(k) is determined to be a value obtained by dividing H_I(k) by H_C(k) and the value of M_C(k) is determined to be 1. In contrast, when the value of H_I(k) is not smaller than the value of H_C(k), the value of M_I(k) is determined to be 1 and the value of M_C(k) is determined to a value obtained by dividing H_C(k) by H_I(k).

(Second Method of MITF—Cutting)

According to a second exemplary embodiment of the present invention, when the HRTF which is a denominator of the ITF at a specific frequency index k, that is, the ipsilateral HRTF has a notch component, values of the ipsilateral MITF and the contralateral MITF at the frequency index k may be set to be 1 (that is, 0 dB). A second exemplary embodiment of the MITF generating method is mathematically expressed as represented in following Equation 3.

if $(H_I(k)<H_C(k))$ $M_I(k)=1$ $M_C(k)=1$ else $M_I(k)=1$ $M_C(k)=H_C(k)/H_I(k)$ [Equation 3]

That is, according to the second exemplary embodiment, when the value of H_I(k) is smaller than the value of H_C(k) at a specific frequency index k (that is, in a notch region), values of M_I(k) and M_C(k) are determined to be 1. In contrast, when the value of H_I(k) is not smaller than the value of H_C(k), the ipsilateral MITF and the contralateral MITF may be set to be same as the ipsilateral ITF and the contralateral ITF, respectively. That is, the value of MITF M_I(k) is determined to be 1 and the value of M_C(k) is determined to be a value obtained by dividing H_C(k) by H_I(k).

(Third Method of MITF—Scaling)

According to a third exemplary embodiment of the present invention, a weight is reflected to the HRTF having the notch component to reduce the depth of the notch. In order to reflect a weight which is larger than 1 to the notch component of HRTF which is a denominator of ITF, that is, the notch component of the ipsilateral HRTF, a weight function w(k) may be applied as represented in Equation 4.

if $(H_I(k)<H_C(k))$ $M_I(k)=1$ $M_C(k)=H_C(k)/(w(k)*H_I(k))$ else $M_I(k)=1$ $M_C(k)=H_C(k)/H_I(k)$ [Equation 4]

Herein, the symbol * refers to multiplication. That is, according to the third exemplary embodiment, when the value of H_I(k) is smaller than the value of H_C(k) at a specific frequency index k (that is, in a notch region), M_I(k) is determined to be 1 and the value of M_C(k) is determined to be a value obtained by dividing H_C(k) by multiplication of w(k) and H_I(k). In contrast, when the value of H_I(k) is not smaller than the value of H_C(k), the value of M_I(k) is determined to be 1 and the value of M_C(k) is determined to a value obtained by dividing H_C(k) by H_I(k). That is, the weight function w(k) is applied when the value of H_I(k) is smaller than the value of H_C(k). According to an exemplary embodiment, the weight function w(k) is set to have the larger value as the depth of the notch of the ipsilateral HRTF becomes larger, that is, as the value of the ipsilateral HRTF becomes smaller. According to another exemplary embodiment, the weight function w(k) may be set to have the large value as the difference between the value of the ipsilateral HRTF and the value of the contralateral HRTF becomes larger.

Conditions of the first, the second and the third exemplary embodiments may extend to a case in which the value of H_I(k) is smaller than a predetermined ratio α of the value of H_C(k) at a specific frequency index k. That is, when the value of H_I(k) is smaller than a value of α*H_C(k), the ipsilateral MITF and the contralateral MITF may be generated based on equations in a conditional statement in each exemplary embodiment. In contrast, when the value of H_I(k) is not smaller than the value of α*H_C(k), the ipsilateral MITF and the contralateral MITF may be set to be same as the ipsilateral ITF and the contralateral ITF. Further, the condition parts of the first, the second and the third exemplary embodiments may be used to be limited to the specific frequency band and different values may be applied to the predetermined ratio α depending on the frequency band.

(Fourth-One Method of MITF—Notch Separating)

Figure 5:
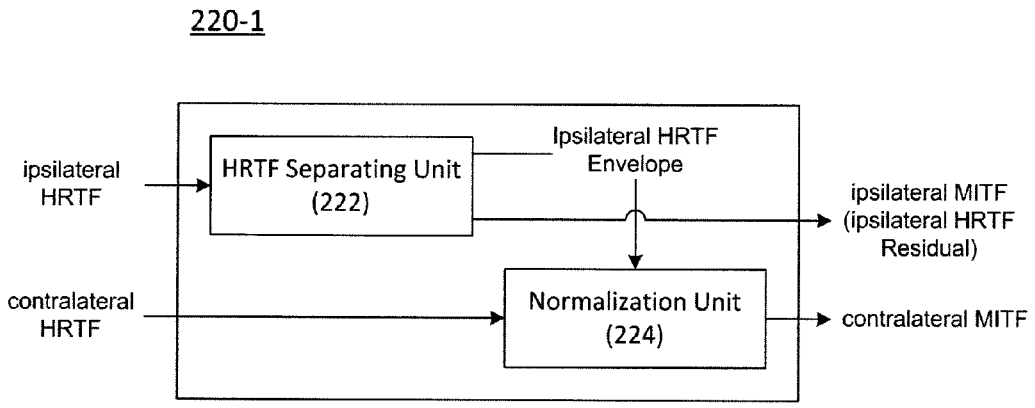
FIG. 5 is a diagram illustrating a MITF generating method according to another exemplary embodiment of the present invention.

According to a fourth exemplary embodiment of the present invention, the notch component of HRTF is separated and the MITF may be generated based on the separated notch component. FIG. 5 is a diagram illustrating a MITF generating method according to the fourth exemplary embodiment of the present invention. The MITF generating unit 220-1 may further include an HRTF separating unit 222 and a normalization unit 224. The HRTF separating unit 222 separates the prototype transfer function, that is, HRTF into an HRTF envelope component and an HRTF notch component.

According to the exemplary embodiment of the present invention, the HRTF separating unit 222 separates HRTF which is a denominator of ITF, that is, the ipsilateral HRTF into an HRTF envelope component and an HRTF notch component and the MITF may be generated based on the separated ipsilateral HRTF envelope component and ipsilateral HRTF notch component. The fourth exemplary embodiment of the MITF generating method is mathematically expressed as represented in the following Equation 5.

$M_I(k)=H_I_\text{notch}(k)$ $M_C(k)=H_C_\text{notch}(k)*H_C_\text{env}(k)/H_I_\text{env}(k)$ [Equation 5]

Herein, k indicates a frequency index, H_I_notch(k) indicates an ipsilateral HRTF notch component, H_I_env(k) indicates an ipsilateral HRTF envelope component, H_C_notch(k) indicates a contralateral HRTF notch component, and H_C_env(k) indicates a contralateral HRTF envelope component. The symbol * refers to multiplication and H_C_notch(k)*H_C_env(k) may be replaced by non-separated contralateral HRTF H_C(k).

That is, according to the fourth exemplary embodiment, M_I(k) is determined to be a value of a notch component H_I_notch(k) which is extracted from the ipsilateral HRTF and M_C(k) is determined to be a value obtained by dividing the contralateral HRTF H_C(k) by an envelope component H_I_env(k) extracted from the ipsilateral HRTF. Referring to FIG. 5, the HRTF separating unit 222 extracts the ipsilateral HRTF envelope component from the ipsilateral HRTF and a remaining component of the ipsilateral HRTF, that is, the notch component is output as the ipsilateral MITF. Further, the normalization unit 224 receives the ipsilateral HRTF envelope component and the contralateral HRTF and generates and outputs the contralateral MITF in accordance with the exemplary embodiment of Equation 5.

Spectral notch is generally generated when a reflection is generated in a specific position of an external ear so that the spectral notch of HRTF may significantly contribute to recognizing an elevation perception. Generally, the notch is characterized by rapid change in a spectral domain. In contrast, the binaural cue represented by the ITF is characterized by slow change in the spectrum domain. Therefore, according to an exemplary embodiment, the HRTF separating unit 222 separates the notch component of the HRTF using homomorphic signal processing using cepstrum or wave interpolation.

For example, the HRTF separating unit 222 performs windowing the cepstrum of the ipsilateral HRTF to obtain an ipsilateral HRTF envelope component. The MITF generating unit 200 divides each of the ipsilateral HRTF and the contralateral HRTF by the ipsilateral HRTF envelope component, thereby generating an ipsilateral MITF from which a spectral coloration is removed. Meanwhile, according to an additional exemplary embodiment of the present invention, the HRTF separating unit 222 may separate the notch component of the HRTF using all-pole modeling, pole-zero modeling, or a group delay function.

Meanwhile, according to an additional exemplary embodiment of the present invention, H_I_notch(k) is approximated to FIR filter coefficients or IIR filter coefficients and the approximated filter coefficients may be used as an ipsilateral transfer function of the binaural rendering. That is, the ipsilateral filtering unit of the direction renderer filters the input audio signal with the approximated filter coefficients to generate the ipsilateral output signal.

(Fourth-Two Method of MITF—Notch Separating/Using HRTF Having Different Altitude)

According to an additional exemplary embodiment of the present invention, in order to generate MITF for a specific angle, an HRTF envelope component having a direction which is different from that of the input audio signal may be used. For example, the MITF generating unit 200 normalizes another HRTF pair (an ipsilateral HRTF and a contralateral HRTF) with the HRTF envelope component on a horizontal plane (that is, an altitude is zero) to implement the transfer functions located on the horizontal plane to be an MITF having a flat spectrum. According to an exemplary embodiment of the present invention, the MITF may be generated by a method of the following Equation 6.

$$M_I(k,\theta,\phi)=H_I_\text{notch}(k,\theta,\phi)$$

$$M_C(k,\theta,\phi)=H_C(k,\theta,\phi)H_I_\text{env}(k,\theta,\phi) \quad \text{[Equation 6]}$$

Herein, k is a frequency index, θ is an altitude, ϕ is an azimuth.

That is, the ipsilateral MITF M_I(k, θ, ϕ) of the altitude θ and the azimuth ϕ is determined by a notch component H_I_notch(k, θ, ϕ) extracted from the ipsilateral HRTF of the altitude θ and the azimuth ϕ, and the contralateral MITF M_C(k, θ, ϕ) is determined by a value obtained by dividing the contralateral HRTF H_C(k, θ, ϕ) of the altitude θ and the azimuth ϕ by the envelope component H_I_env(k, θ, ϕ) extracted from the ipsilateral HRTF of the altitude 0 and the azimuth ϕ. According to another exemplary embodiment of the present invention, the MITF may be generated by a method of the following Equation 7.

$$M_I(k,\theta,\phi)=H_I_(k,\theta,\phi)/H_I_\text{env}(k,\theta,\phi)$$

$$M_C(k,\theta,\phi)=H_C(k,\theta,\phi)/H_I_\text{env}(k,\theta,\phi) \quad \text{[Equation 7]}$$

That is, the ipsilateral MITF M_I(k, θ, ϕ) of the altitude θ and the azimuth ϕ is determined by a value obtained by dividing the ipsilateral HRTF H_I(k, θ, ϕ) of the altitude θ and the azimuth ϕ by the H_I_env(k, θ, ϕ) and the contralateral MITF M_C(k, θ, ϕ) is determined by a value obtained by dividing the contralateral HRTF H_C(k, θ, ϕ) of the altitude θ and the azimuth ϕ by the H_I_env(k, θ, ϕ). In Equations 6 and 7, it is exemplified that an HRTF envelope component having the same azimuth and different altitude (that is, the altitude 0) is used to generate the MITF. However, the present invention is not limited thereto and the MITF may be generated using an HRTF envelope component having a different azimuth and/or a different altitude.

(Fifth Method of MITF—Notch Separating 2)

According to a fifth exemplary embodiment of the present invention, the MITF may be generated using wave interpolation which is expressed by spatial/frequency axes. For example, the HRTF is separated into a slowly evolving waveform (SEW) and a rapidly evolving waveform (REW) which are three-dimensionally expressed by an altitude/frequency axis or an azimuth/frequency axis. In this case, the binaural cue (for example, ITF, interaural parameter) for binaural rendering is extracted from the SEW and the notch component is extracted from the REW.

According to an exemplary embodiment of the present invention, the direction renderer performs the binaural rendering using a binaural cue extracted from the SEW and directly applies the notch component extracted from the REW to each channel (an ipsilateral channel/a contralateral channel) to suppress a tone noise. In order to separate the SEW and the REW in the wave interpolation of the spatial/frequency domain, methods of a homomorphic signal processing, a low/high pass filtering, and the like may be used.

(Sixth Method of MITF—Notch Separating 3)

According to a sixth exemplary embodiment of the present invention, in a notch region of the prototype transfer function, the prototype transfer function is used for the binaural filtering and in a region other than the notch region, the MITF according to the above-described exemplary embodiments may be used for the binaural filtering. This will be mathematically expressed by the following Equation 8.

If $k$ lies notch region $$M'_I(k)=H_I(k)$$

$$M'_C(k)=H_C(k)$$

else $$M'_I(k)=M_I(k)$$

$$M'_C(k)=M_C(k) \quad \text{[Equation 8]}$$

Herein, M'_I(k) and M'_C(k) are the ipsilateral MITF and the contralateral MITF according to the sixth exemplary embodiment and M_I(k) and M_C(k) are the ipsilateral MITF and the contralateral MITE according to any one of the above-described exemplary embodiments. H_I(k) and H_C(k) indicate the ipsilateral HRTF and the contralateral HRTF which are prototype transfer functions. That is, in the case of the frequency band in which the notch component of the ipsilateral HRTF is included, the ipsilateral HRTF and the contralateral HRTF are used as the ipsilateral transfer function and the contralateral transfer function of the binaural rendering, respectively. Further, in the case of the frequency band in which the notch component of the ipsilateral HRTF is not included, the ipsilateral MITF and the contralateral MITF are used as the ipsilateral transfer function and the contralateral transfer function of the binaural rendering, respectively. In order to separate the notch region, as described above, the all-pole modeling, the pole-zero modeling, the group delay function, and the like may be used. According to an additional exemplary embodiment of the present invention, smoothing techniques such as low pass filtering may be used in order to prevent degradation of a sound quality due to sudden spectrum change at a boundary of the notch region and the non-notch region.

(Seventh Method of MITF—Notch Separating with Low Complexity)

Figure 6:
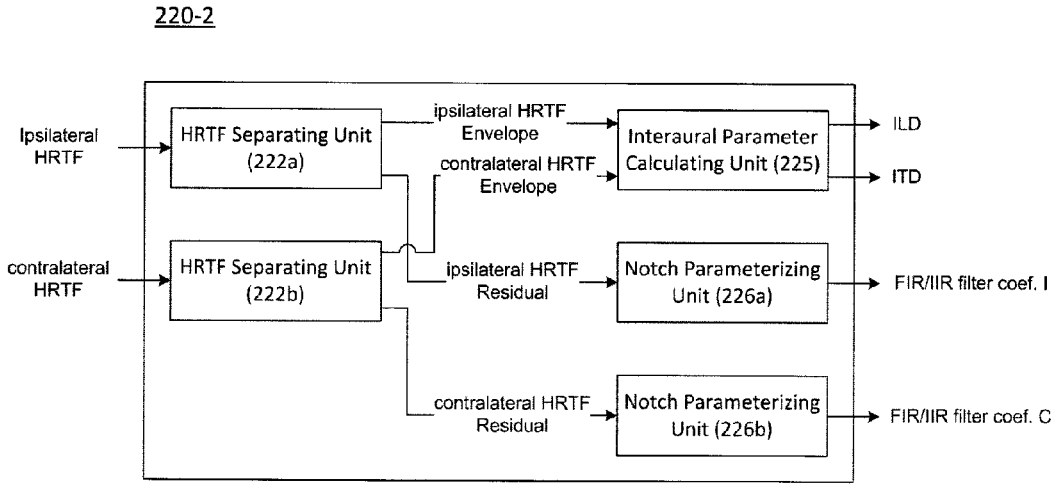
FIG. 6 is a diagram illustrating a binaural parameter generating method according to another exemplary embodiment of the present invention.
Figure 7:
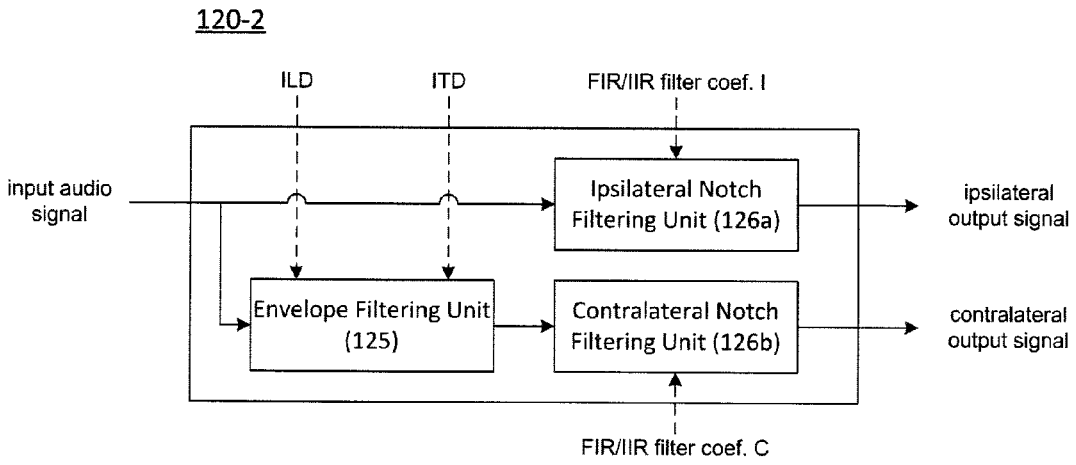
FIG. 7 is a block diagram of a direction renderer according to another exemplary embodiment of the present invention.

According to a seventh exemplary embodiment of the present invention, a remaining component of the HRTF separation, that is, the notch component may be processed by a simpler operation. According to an exemplary embodiment, the HRTF remaining component is approximated to FIR filter coefficients or IIR filter coefficients, and the approximated filter coefficients may be used as the ipsilateral and/or contralateral transfer function of the binaural rendering. FIG. 6 is a diagram illustrating a binaural parameter generating method according to the seventh exemplary embodiment of the present invention and FIG. 7 is a block diagram of a direction renderer according to the seventh exemplary embodiment of the present invention.

First, FIG. 6 illustrates a binaural parameter generating unit 220-2 according to an exemplary embodiment of the present invention. Referring to FIG. 6, the binaural parameter generating unit 220-2 includes HRTF separating units 222*a* and 222*b*, an interaural parameter calculating unit 225, and notch parameterizing units 226*a* and 226*b*. According to an exemplary embodiment, the binaural parameter generating unit 220-2 may be used as a configuration replacing the MITF generating unit of FIGS. 4 and 5.

First, the HRTF separating units 222*a* and 222*b* separate the input HRTF into an HRTF envelope component and an HRTF remaining component. A first HRTF separating unit 222*a* receives the ipsilateral HRTF and separates the ipsilateral HRTF into an ipsilateral HRTF envelope component and an ipsilateral HRTF remaining component. A second HRTF separating unit 222*b* receives the contralateral HRTF and separates the contralateral HRTF into a contralateral HRTF envelope component and a contralateral HRTF remaining component. The interaural parameter calculating unit 225 receives the ipsilateral HRTF envelope component and the contralateral HRTF envelope component and generates an interaural parameter using the components. The interaural parameter includes an interaural level difference (ILD) and an interaural time difference (ITD). In this case, the ILD corresponds to a size of an interaural transfer function and the ITD corresponds to a phase (or a time difference in the time domain) of the interaural transfer function.

Meanwhile, the notch parameterizing units 226*a* and 226*b* receive the HRTF remaining component and approximate the HRTF remaining component to impulse response (IR) filter coefficients. The HRTF remaining component includes the HRTF notch component and the IR filter includes an FIR filter and an IIR filter. The first notch parameterizing unit 226*a* receives the ipsilateral HRTF remaining component and generates ipsilateral IR filter coefficients using the same. The second notch parameterizing unit 226*b* receives the contralateral HRTF remaining component and generates contralateral IR filter coefficients using the same.

As described above, the binaural parameter generated by the binaural parameter generating unit 220-2 is transferred to the direction renderer. The binaural parameter includes an interaural parameter and the ipsilateral/contralateral IR filter coefficients. In this case, the interaural parameter includes at least ILD and ITD.

FIG. 7 is a block diagram of a direction renderer 120-2 according to an exemplary embodiment of the present invention. Referring to FIG. 7, the direction renderer 120-2 includes an envelope filtering unit 125 and ipsilateral/contralateral notch filtering units 126*a* and 126*b*. According to an exemplary embodiment, the ipsilateral notch filtering unit 126*a* may be used as a component replacing the ipsilateral filtering unit 122*a* of FIG. 2, and the envelope filtering unit 125 and the contralateral notch filtering unit 126*b* may be used as components replacing the contralateral filtering unit 122*b* of FIG. 2.

First, the envelope filtering unit 125 receives the interaural parameter and filters the input audio signal based on the received interaural parameter to reflect a difference between ipsilateral/contralateral envelopes. According to the exemplary embodiment of FIG. 7, the envelope filtering unit 125 may perform filtering for the contralateral signal, but the present invention is not limited thereto. That is, according to another exemplary embodiment, the envelope filtering unit 125 may perform filtering for the ipsilateral signal. When the envelope filtering unit 125 performs the filtering for the contralateral signal, the interaural parameter may indicate relative information of the contralateral envelope with respect to the ipsilateral envelope and when the envelope filtering unit 125 performs the filtering for the ipsilateral signal, the interaural parameter may indicate relative information of the ipsilateral envelope with respect to the contralateral envelope.

Next, the notch filtering units 126*a* and 126*b* perform filtering for the ipsilateral/contralateral signals to reflect the notches of the ipsilateral/contralateral transfer functions, respectively. The first notch filtering unit 126*a* filters the input audio signal with the ipsilateral IR filter coefficients to generate an ipsilateral output signal. The second notch filtering unit 126*b* filters the input audio signal on which the envelope filtering is performed with the contralateral IR filter coefficients to generate a contralateral output signal. Even though the envelope filtering is performed prior to the notch filtering in the exemplary embodiment of FIG. 7, the present invention is not limited thereto. According to another exemplary embodiment of the present invention, the envelope filtering may be performed on the ipsilateral or contralateral signal after performing the ipsilateral/contralateral notch filtering the input audio signal.

As described above, according to the exemplary embodiment of FIG. 7, the direction renderer 120-2 performs the ipsilateral filtering using the ipsilateral notch filtering unit 126*a*. Further, the direction renderer 120-2 performs the contralateral filtering using the envelope filtering unit 125 and the contralateral notch filtering unit 126*b*. In this case, the ipsilateral transfer function which is used for the ipsilateral filtering includes IR filter coefficients which are generated based on the notch component of the ipsilateral HRTF. Further, the contralateral transfer function used for the contralateral filtering includes IR filter coefficients which are generated based on the notch component of the contralateral HRTF, and the interaural parameter. Herein, the interaural parameter is generated based on the envelope component of the ipsilateral HRTF and the envelope component of the contralateral HRTF.

(Eighth Method of MITF—Hybrid ITF)

According to an eighth exemplary embodiment of the present invention, a hybrid ITF (HITF) in which two or more of the above mentioned ITF and MITF are combined may be used. In an exemplary embodiment of the present invention, the HITF indicates an interaural transfer function in which a transfer function used in at least one frequency band is different from a transfer function used in the other frequency band. That is, the ipsilateral and contralateral transfer functions which are generated based on different transfer functions in a first frequency band and a second frequency band may be used. According to an exemplary embodiment of the present invention, the ITF is used for the binaural rendering of the first frequency band and the MITF is used for the binaural rendering of the second frequency band.

More specifically, in the low frequency band, a level difference of both ears, a phase difference of both ears, and the like are important factors of the sound image localization and in the high frequency band, a spectral envelope, a specific notch, a peak, and the like are important clues of the sound image localization. Accordingly, in order to efficiently reflect this, the ipsilateral and contralateral transfer functions of the low frequency band are generated based on the ITF and the ipsilateral and contralateral transfer functions of the high frequency band are generated based on the MITF. This will be mathematically expressed by the following Equation 9.

if $(k<C0)$ $h_I(k)=I_I(k)$ $h_C(k)=I_C(k)$ else $h_I(k)=M_I(k)$ $h_C(k)=M_C(k)$ [Equation 9]

Herein, k is a frequency index, C0 is a critical frequency index, h_I(k) and h_C(k) are ipsilateral and contralateral HITFs according to an exemplary embodiment of the present inventions, respectively. Further, I_I(k) and I_C(k) indicate the ipsilateral and contralateral ITFs and M_I(k) and M_C(k) indicate ipsilateral and contralateral MITFs according to any one of the above-described exemplary embodiments.

That is, according to an exemplary embodiment of the present invention, the ipsilateral and contralateral transfer functions in a first frequency band whose frequency index is lower than the critical frequency index are generated based on the ITF and the ipsilateral and contralateral transfer functions in a second frequency band whose frequency index is equal to or higher than the critical frequency index are generated based on the MITE. According to an exemplary embodiment, the critical frequency index C0 indicates a specific frequency between 500 Hz and 2 kHz.

Meanwhile, according to another exemplary embodiment of the present invention, the ipsilateral and contralateral transfer functions of the low frequency band are generated based on the ITF, the ipsilateral and contralateral transfer functions of the high frequency band are generated based on the MITF, and ipsilateral and contralateral transfer functions in an intermediate frequency band between the low frequency band and the high frequency band are generated based on a linear combination of the ITF and the MITF. This will be mathematically expressed by the following Equation 10.

if $(k<C1)$ $h_I(k)=I_I(k)$ $h_C(k)=I_C(k)$ else if $(C1\leq k\leq 2)$ $h_I(k)=g1(k)*I_I(k)+g2(k)*M_I(k)$ $h_C(k)=g1(k)*I_C(k)+g2(k)*M_C(k)$ else $h_I(k)=M_I(k)$ $h_C(k)=M_C(k)$ [Equation 10]

Herein, C1 indicates a first critical frequency index and C2 indicates a second critical frequency index. Further, g1(k) and g2(k) indicate gains for the ITF and the MITF at the frequency index k, respectively.

That is, according to another exemplary embodiment of the present invention, the ipsilateral and contralateral transfer functions in a first frequency band whose frequency index is lower than the first critical frequency index are generated based on the ITF, and the ipsilateral and contralateral transfer functions in a second frequency band whose frequency index is higher than the second critical frequency index are generated based on the MITF. Further, the ipsilateral and contralateral transfer functions of a third frequency band whose frequency index is between the first critical frequency index and the second frequency index are generated based on a linear combination of the ITF and the MITF. However, the present invention is not limited thereto and the ipsilateral and contralateral transfer functions of the third frequency band may be generated based on at least one of a log combination, a spline combination, and a Lagrange combination of the ITF and the MITF.

According to an exemplary embodiment, the first critical frequency index C1 indicates a specific frequency between 500 Hz and 1 kHz, and the second critical frequency index C2 indicates a specific frequency between 1 kHz and 2 kHz. Further, for the sake of energy conservation, a value of sum of squares of gains g1(k) and g2(k) may satisfy g1(k)^2+g2(k)^2=1. However, the present invention is not limited thereto.

Meanwhile, the transfer function generated based on the ITF and the transfer function generated based on the MITF may have different delays. According to an exemplary embodiment of the present invention, when a delay of the ipsilateral/contralateral transfer functions of a specific frequency band is different from a delay of the ipsilateral/contralateral transfer functions of a different frequency band, delay compensation may be further performed on ipsilateral/contralateral transfer functions having a short delay with respect to the ipsilateral/contralateral transfer function having a long delay.

According to another exemplary embodiment of the present invention, the ipsilateral and contralateral HRTFs are used for the ipsilateral and contralateral transfer functions of the first frequency band and the ipsilateral and contralateral transfer functions of the second frequency band may be generated based on the MITF. Alternatively, the ipsilateral and contralateral transfer functions of the first frequency band may be generated based on information extracted from at least one of ILD, ITD, interaural phase difference (IPD), and interaural coherence (IC) of the ipsilateral and the contralateral HRTFs for each frequency band and the ipsilateral and contralateral transfer functions of the second frequency band may be generated based on the MITE.

According to another exemplary embodiment of the present invention, the ipsilateral and contralateral transfer functions of the first frequency band are generated based on the ipsilateral and contralateral HRTFs of a spherical head model and the ipsilateral and contralateral transfer functions of the second frequency band are generated based on the measured ipsilateral and contralateral HRTFs. According to an exemplary embodiment, the ipsilateral and contralateral transfer functions of a third frequency band between the first frequency band and the second frequency band may be generated based on the linear combination, overlapping, windowing, and the like of the HRTF of the spherical head model and the measured HRTF.

(Ninth Method of MITF—Hybrid ITF 2)

According to a ninth exemplary embodiment of the present invention, a hybrid ITF (HITF) in which two or more of HRTF, ITF and MITF are combined may be used. According to the exemplary embodiment of the present invention, in order to increase a sound phase localization performance, a spectral characteristic of a specific frequency band may be emphasized. When the above-described ITF or MITF is used, coloration of the sound source is reduced, but a trade-off phenomenon that the performance of sound image localization is also lowered is caused. Therefore, in order to improve the performance of the sound image localization, additional refinement for the ipsilateral/contralateral transfer functions is required.

According to an exemplary embodiment of the present invention, the ipsilateral and contralateral transfer functions of a low frequency band which dominantly affect the coloration of the sound source are generated based on the MITF (or ITF), and the ipsilateral and contralateral transfer functions of a high frequency band which dominantly affect the sound image localization are generated based on the HRTF. This will be mathematically expressed by the following Equation 11.

$$\begin{aligned}
&\text{if } (k<C0)\\
&h_I(k)=M_I(k)\\
&h_C(k)=M_C(k)\\
&\text{else}\\
&h_I(k)=H_I(k)\\
&h_C(k)=H_C(k)
\end{aligned} \qquad \text{[Equation 11]}$$

Herein, k is a frequency index, C0 is a critical frequency index, h_I(k) and h_C(k) are ipsilateral and contralateral HITFs according to an exemplary embodiment of the present inventions, respectively. Further, HI_I(k) and H_C(k) indicate the ipsilateral and contralateral HRTFs and M_I(k) and M_C(k) indicate ipsilateral and contralateral MITFs according to any one of the above-described exemplary embodiments.

That is, according to an exemplary embodiment of the present invention, the ipsilateral and contralateral transfer functions in a first frequency band whose frequency index is lower than the critical frequency index are generated based on the MITF, and the ipsilateral and contralateral transfer functions in a second frequency band whose frequency index is equal to or higher than the critical frequency index are generated based on the HRTF. According to an exemplary embodiment, the critical frequency index C0 indicates a specific frequency between 2 kHz and 4 kHz, but the present invention is not limited thereto.

According to another exemplary embodiment of the present invention, the ipsilateral and contralateral transfer functions are generated based on the ITF and a separate gain may be applied to the ipsilateral and contralateral transfer functions of the high frequency band. This will be mathematically expressed by the following Equation 12.

$$\begin{aligned}
&\text{if } (k<C0)\\
&h_I(k)=1\\
&h_C(k)=H_C(k)/H_I(k)\\
&\text{else}\\
&h_I(k)=G\\
&h_C(k)=G*H_C(k)/H_I(k)
\end{aligned} \qquad \text{[Equation 12]}$$

Herein, G indicates a gain. That is, according to another exemplary embodiment of the present invention, the ipsilateral and contralateral transfer functions in a first frequency band whose frequency index is lower than the critical frequency index are generated based on the ITF, and the ipsilateral and contralateral transfer functions in a second frequency band whose frequency index is equal to or higher than the critical frequency index are generated based on a value obtained by multiplying the ITF and a predetermined gain G.

According to another exemplary embodiment of the present invention, the ipsilateral and contralateral transfer functions are generated based on the MITF according to any one of the above-described exemplary embodiments and a separate gain may be applied to the ipsilateral and contralateral transfer functions of the high frequency band. This will be mathematically expressed by the following Equation 13.

$$\begin{aligned}
&\text{if } (k<C0)\\
&h_I(k)=M_I(k)\\
&h_C(k)=M_C(k)\\
&\text{else}\\
&h_I(k)=G*M_I(k)\\
&h_C(k)=G*M_C(k)
\end{aligned} \qquad \text{[Equation 13]}$$

That is, according to another exemplary embodiment of the present invention, the ipsilateral and contralateral transfer functions in a first frequency band whose frequency index is lower than the critical frequency index are generated based on the MITF and the ipsilateral and contralateral transfer functions in a second frequency band whose frequency index is equal to or higher than the critical frequency index are generated based on a value obtained by multiplying the MITF and the predetermined gain G.

The gain G which is applied to the HITF may be generated according to various exemplary embodiments. According to an exemplary embodiment, in the second frequency band, an average value of HRTF magnitudes having the maximum altitude and an average value of HRTF magnitudes having the minimum altitude are calculated, respectively, and the gain G may be obtained based on interpolation using a difference between two average values. In this case, different gains are applied for each frequency bin of the second frequency band so that resolution of the gain may be improved.

Meanwhile, in order to prevent distortion caused by discontinuity between the first frequency band and the second frequency band, a gain which is smoothened at a frequency axis may be additionally used. According to an exemplary embodiment, a third frequency band may be set between the first frequency band in which the gain is not applied and the second frequency band in which the gain is applied. A smoothened gain is applied to ipsilateral and contralateral transfer functions of the third frequency band. The smoothened gain may be generated based on at least one of linear interpolation, log interpolation, spline interpolation, and Lagrange interpolation. Since the smoothened gain has different values for each bin, the smoothened gain may be expressed as G(k).

Figure 8:
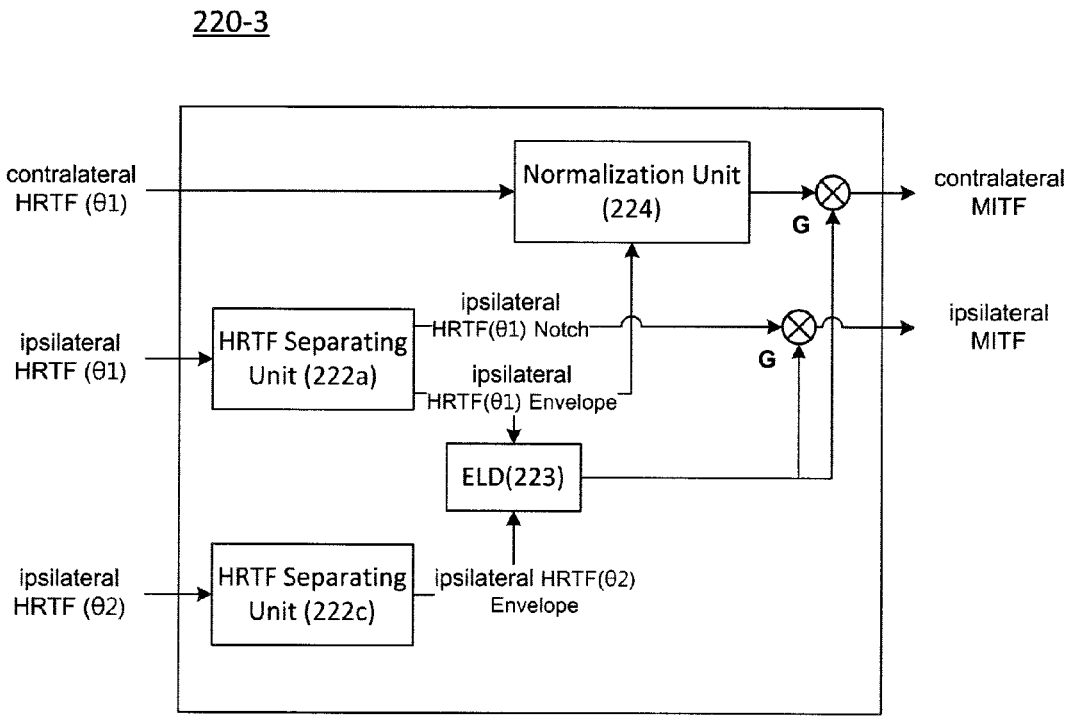
FIG. 8 is a diagram illustrating a MITF generating method according to another exemplary embodiment of the present invention.

According to another exemplary embodiment of the present invention, the gain G may be obtained based on an envelope component extracted from HRTF having different altitude. FIG. 8 is a diagram illustrating an MITF generating method to which a gain according to another exemplary embodiment of the present invention is applied. Referring to FIG. 8, an MITF generating unit 220-3 includes HRTF separating units 222*a* and 222*c*, an elevation level difference (ELD) calculating unit 223, and a normalization unit 224.

FIG. 8 illustrates an exemplary embodiment in which the MITF generating unit 223-3 generates ipsilateral and contralateral MITFs having a frequency k, an altitude θ1, and an azimuth ϕ. First, the first HRTF separating unit 222*a* separates the ipsilateral HRTF having an altitude θ1 and an azimuth ϕ into an ipsilateral HRTF envelope component and an ipsilateral HRTF notch component. Meanwhile, the second HRTF separating unit 222*c* separates an ipsilateral HRTF having a different altitude θ2 into an ipsilateral HRTF envelope component and an ipsilateral HRTF notch component. θ2 is an altitude which is different from θ1 and according to an exemplary embodiment, θ2 may be set to be 0 degree (that is, an angle on the horizontal plane).

The ELD calculating unit 223 receives an ipsilateral HRTF envelope component of the altitude θ1 and an ipsilateral HRTF envelope component of the altitude θ2 and generates the gain G based thereon. According to an exemplary embodiment, the ELD calculating unit 223 sets the gain value to be close to 1 as a frequency response is not significantly changed in accordance with the change of the altitude and sets the gain value to be amplified or attenuated as the frequency response is significantly changed.

The MITF generating unit 222-3 generates the MITF using a gain generated in the ELD calculating unit 223. Equation 14 represents an exemplary embodiment in which the MITF is generated using the generated gain.

$$\begin{aligned}
&\text{if } (k<C0)\\
&M_I(k,\theta1,\phi)=H_I_\text{notch}(k,\theta1,\phi)\\
&M_C(k,\theta1,\phi)=H_C(k,\theta1,\phi)/H_I_\text{env}(k,\theta1,\phi)\\
&\text{else}\\
&M_I(k,\theta1,\phi)=G*H_I_\text{notch}(k,\theta1,\phi)\\
&M_C(k,\theta1,\phi)=G*H_C(k,\theta1,\phi)/H_I_\text{env}(k,\theta1,\phi)
\end{aligned} \qquad \text{[Equation 14]}$$

Ipsilateral and contralateral transfer functions in a first frequency band whose frequency index is lower than a critical frequency index are generated based on the MITF according to an exemplary embodiment of Equation 5. That is, an ipsilateral MITF M_I(k, θ1, ϕ) of the altitude θ1 and the azimuth ϕ is determined by a notch component H_I_notch(k, θ1, ϕ) extracted from the ipsilateral HRTF and a contralateral MITF M_C(k, θ1, ϕ) is determined by a value obtained by dividing the contralateral HRTF H_C(k, θ1, ϕ) by an envelope component H_I_env(k, θ1, ϕ) extracted from the ipsilateral HRTF.

However, ipsilateral and contralateral transfer functions in a second frequency band whose frequency index is equal to or larger than the critical frequency index are generated based on a value obtained by multiplying the MITF according to the exemplary embodiment of Equation 5 and the gain G. That is, M_I(k, θ1, ϕ) is determined by a value obtained by multiplying a notch component H_I_notch(k, θ1, ϕ) extracted from the ipsilateral HRTF and the gain G and M_C(k, θ1, ϕ) is determined by a value obtained by dividing a value obtained by mortifying the contralateral HRTF H_C(k, θ1, ϕ) and the gain G by an envelope component H_I_env(k, θ1, ϕ) extracted from the ipsilateral HRTF.

Therefore, referring to FIG. 8, the ipsilateral HRTF notch component separated by the first HRTF separating unit 222*a* and the gain G are multiplied to be output as an ipsilateral MITF. Further, the normalization unit 224 calculates the contralateral HRTF value compared to the ipsilateral HRTF envelope component as represented in Equation 14 and the calculated value and the gain G are multiplied to be output as a contralateral MITE In this case, the gain G is a value generated based on the ipsilateral HRTF envelope component having the altitude θ1 and an ipsilateral HRTF envelope component having a different altitude θ2. Equation 15 represents an exemplary embodiment in which the gain G is generated.

$$G=H_I_\text{env}(k,\theta2,\phi)H_I_\text{env}(k,\theta1,\phi) \qquad \text{[Equation 15]}$$

That is, the gain G may be determined by a value obtained by dividing the envelope component H_I_env(k, θ1, ϕ) extracted from the ipsilateral HRTF of the altitude θ1 and the azimuth ϕ by an envelope component H_I_env(k, θ2, ϕ) extracted from the ipsilateral HRTF of the altitude θ2 and the azimuth ϕ.

Meanwhile, in the above exemplary embodiment, the gain G is generated using envelope components of the ipsilateral HRTFs having different altitudes, but the present invention is not limited thereto. That is, the gain G may be generated based on envelope components of ipsilateral HRTFs having different azimuths, or envelope components of ipsilateral HRTFs having different altitudes and different azimuths. Further, the gain G may be applied not only to the HITF, but also to at least one of the ITF, MITF, and HRTF. Further, the gain G may be applied not only to a specific frequency band such as a high frequency band, but also to all frequency bands.

The ipsilateral MITF (or ipsilateral HITF) according to the various exemplary embodiments is transferred to the direction renderer as the ipsilateral transfer function and the contralateral MITF (or the contralateral HITF) is transferred to the direction renderer as the contralateral transfer function. The ipsilateral filtering unit of the direction renderer filters the input audio signal with the ipsilateral MITF (or the ipsilateral HITF) according to the above-described exemplary embodiment to generate an ipsilateral output signal and the contralateral filtering unit filters the input audio signal with the contralateral MITF (or the contralateral HITF) according to the above-described exemplary embodiment to generate a contralateral output signal.

In the above exemplary embodiment, when the value of the ipsilateral MITF or the contralateral MITF is 1, the ipsilateral filtering unit or the contralateral filtering unit may bypass the filtering operation. In this case, whether to bypass the filtering may be determined at a rendering time. However, according to another exemplary embodiment, when the prototype transfer function HRTF is determined in advance, the ipsilateral/contralateral filtering unit obtains additional information on a bypass point (for example, a frequency index) in advance and determines whether to bypass the filtering at each point based on the additional information.

Meanwhile, in the above-described exemplary embodiment and drawings, it is described that the ipsilateral filtering unit and the contralateral filtering unit receive the same input audio signal to receive the filtering, but the present invention is not limited thereto. According to another exemplary embodiment of the present invention, two channel signals on which the preprocessing is performed are received as an input of the direction renderer. For example, an ipsilateral signal d^I and a contralateral signal d^C on which the distance rendering is performed as the preprocessing step are received as an input of the direction renderer. In this case, the ipsilateral filtering unit of the direction renderer filters the received ipsilateral signal d^I with the ipsilateral transfer function to generate the ipsilateral output signal B^I. Further, the contralateral filtering unit of the direction renderer filters the received contralateral signal d^C with the contralateral transfer function to generate the contralateral output signal B^C.

The present invention has been described above through specific embodiments, but modifications or changes will be made by those skilled in the art without departing from the object and the scope of the present invention. That is, the present invention has described an exemplary embodiment of the binaural rendering on the audio signal, but the present invention may be similarly applied and extend not only to the audio signal, but also to various multimedia signals including a video signal. Accordingly, if it is easily inferred by those skilled in the art from the detailed description and the exemplary embodiment of the present invention, it is interpreted to be covered by the scope of the present invention.

The invention claimed is:

1. An audio signal processing apparatus to perform binaural filtering an input audio signal, the apparatus comprising:

an ipsilateral filtering unit configured to filter the input audio signal by an ipsilateral transfer function to generate an ipsilateral output signal; and a contralateral filtering unit configured to filter the input audio signal by a contralateral transfer function to generate a contralateral output signal, wherein the ipsilateral and contralateral transfer functions are generated based on different transfer functions in a first frequency band and a second frequency band, wherein the ipsilateral and contralateral transfer functions of the first frequency band are generated based on a first transfer function, the ipsilateral and contralateral transfer functions of the second frequency band which is different from the first frequency band are generated based on a second transfer function, and the ipsilateral and contralateral transfer functions in a third frequency band between the first frequency band and the second frequency band are generated based on a linear combination of the first transfer function and the second transfer function.

2. The apparatus of claim 1, wherein the ipsilateral and contralateral transfer functions of the first frequency band are generated based on an interaural transfer function (ITF) and the ITF is generated based on a value obtained by dividing an ipsilateral head related transfer function (HRTF) by a contralateral HRTF with respect to the input audio signal.

3. The apparatus of claim 1, wherein the ipsilateral and contralateral transfer functions of the first frequency band are an ipsilateral HRTF and a contralateral HRTF with respect to the input audio signal.

4. The apparatus of claim 1, wherein the ipsilateral and contralateral transfer functions of the second frequency band which is different from the first frequency band are generated based on a modified interaural transfer function (MITF), and wherein the MITF is generated by modifying an interaural transfer function (ITF) based on a notch component of at least one of an ipsilateral HRTF and a contralateral HRTF with respect to the input audio signal.

5. The apparatus of claim 4, wherein the ipsilateral transfer function of the second frequency band is generated based on a notch component extracted from the ipsilateral HRTF and the contralateral transfer function of the second frequency band is generated based on a value obtained by dividing the contralateral HRTF by an envelope component extracted from the ipsilateral HRTF.

6. The apparatus of claim 1, wherein the ipsilateral and contralateral transfer functions of the first frequency band are generated based on information extracted from at least one of an interaural level difference (ILD), an interaural time difference (ITD), an interaural phase difference (IPD), and an interaural coherence (IC) of the ipsilateral HRTF and the contralateral HRTF with respect to the input audio signal for each frequency band.

7. The apparatus of claim 1, wherein the transfer functions of the first frequency band and the second frequency band are generated based on information extracted from the same ipsilateral and contralateral HRTFs.

8. The apparatus of claim 1, wherein the first frequency band is lower than the second frequency band.

9. An audio signal processing method to perform binaural filtering an input audio signal, the method comprising:

receiving an input audio signal;

filtering the input audio signal by an ipsilateral transfer function to generate an ipsilateral output signal; and filtering the input audio signal by a contralateral transfer function to generate a contralateral output signal;

wherein the ipsilateral and contralateral transfer functions are generated based on different transfer functions in a first frequency band and a second frequency band, wherein the ipsilateral and contralateral transfer functions of the first frequency band are generated based on a first transfer function, the ipsilateral and contralateral transfer functions of the second frequency band which is different from the first frequency band are generated based on a second transfer function, and the ipsilateral and contralateral transfer functions in a third frequency band between the first frequency band and the second frequency band are generated based on a linear combination of the first transfer function and the second transfer function.

10. The method of claim 9, wherein the ipsilateral and contralateral transfer functions of the first frequency band are generated based on an interaural transfer function (ITF) and the ITF is generated based on a value obtained by dividing an ipsilateral head related transfer function (HRTF) by a contralateral HRTF with respect to the input audio signal.

11. The method of claim 9, wherein the ipsilateral and contralateral transfer functions of the first frequency band are an ipsilateral HRTF and a contralateral HRTF with respect to the input audio signal.

12. The method of claim 9, wherein the ipsilateral and contralateral transfer functions of the second frequency band which is different from the first frequency band are generated based on a modified interaural transfer function (MITF), and wherein the MITF is generated by modifying an interaural transfer function (ITF) based on a notch component of at least one of an ipsilateral HRTF and a contralateral HRTF with respect to the input audio signal.

13. The method of claim 12, wherein the ipsilateral transfer function of the second frequency band is generated based on a notch component extracted from the ipsilateral HRTF and the contralateral transfer function of the second frequency band is generated based on a value obtained by dividing the contralateral HRTF by an envelope component extracted from the ipsilateral HRTF.

14. The method of claim 9, wherein the ipsilateral and contralateral transfer functions of the first frequency band are generated based on information extracted from at least one of an interaural level difference (ILD), an interaural time difference (ITD), an interaural phase difference (IPD), and an interaural coherence (IC) of the ipsilateral HRTF and the contralateral HRTF with respect to the input audio signal for each frequency band.

15. The method of claim 9, wherein the transfer functions of the first frequency band and the second frequency band are generated based on information extracted from the same ipsilateral and contralateral HRTFs.

16. The method of claim 9, wherein the first frequency band is lower than the second frequency band.

* * * * *